US006026695A

United States Patent [19]

Bartlett et al.

[11] Patent Number: 6,026,695

[45] Date of Patent: Feb. 22, 2000

[54] ENGINE STARTER HOUSING AND AN ANNULAR HOUSING EXTENSION THEREFOR

[75] Inventors: Gregory A. Bartlett, Carthage, N.C.; H. Victor McCormick, Renton, Wash.; Arnie E. Nelson, Pekin, Ill.

[73] Assignee: Ingersoll-Rand Company, Woodcliff Lake, N.J.

[21] Appl. No.: 09/098,220

[22] Filed: Jun. 16, 1998

[51] Int. Cl.[7] ..... F02N 15/06

[52] U.S. Cl. ..... 74/6; 123/179.25; 123/179.31; 290/38 C

[58] Field of Search ..... 74/6, 7 R, 7 A, 74/7 E; 123/179.25, 179.31; 290/38 R, 38 A, 38 C, 48

[56] References Cited

U.S. PATENT DOCUMENTS

| | | | |
|---|---|---|---|
| D. 205,662 | 9/1966 | Bluemink | D26/5 |
| D. 281,239 | 11/1985 | Stevens | D15/5 |
| D. 347,619 | 6/1994 | Van Horn et al. | D13/113 |
| 1,273,170 | 7/1918 | Fisher . | |
| 1,858,617 | 5/1932 | Brownlee | 74/6 |
| 2,358,445 | 9/1944 | Cone | 123/179.31 |
| 2,460,502 | 2/1949 | Heintz | 171/252 |
| 2,481,783 | 9/1949 | Robinson et al. | 74/6 |
| 2,509,361 | 5/1950 | McCreary | 123/179.31 |
| 3,375,813 | 4/1968 | Hamman | 123/185 |
| 3,395,594 | 8/1968 | Blair | 74/606 |
| 3,664,201 | 5/1972 | Vogel et al. | 74/6 |
| 4,071,218 | 1/1978 | Pecka et al. | 248/312.1 |
| 4,273,085 | 6/1981 | Janik, Jr. | 123/179 F |
| 4,362,065 | 12/1982 | Baratti | 74/7 A |
| 4,518,310 | 5/1985 | Coons | 415/36 |
| 4,553,442 | 11/1985 | Mazzorana | 74/7 A |
| 4,808,836 | 2/1989 | Isozumi et al. | 290/48 |
| 4,838,512 | 6/1989 | Lisak et al. | 248/503 |
| 4,846,897 | 7/1989 | Nakagawa et al. | 148/251 |
| 4,931,680 | 6/1990 | Sugiyama | 310/83 |
| 4,941,366 | 7/1990 | Isozumi | 74/6 |
| 4,955,343 | 9/1990 | Ogami | 123/195 R |
| 4,958,530 | 9/1990 | Jaseck et al. | 74/7 A |
| 4,962,340 | 10/1990 | Isozumi | 290/48 |
| 5,036,213 | 7/1991 | Isozumi | 290/48 |
| 5,126,607 | 6/1992 | Merriman, Jr. | 310/51 |
| 5,220,844 | 6/1993 | Mills | 74/6 |
| 5,241,871 | 9/1993 | McKnight, III et al. | 74/7 C |
| 5,255,644 | 10/1993 | Mills et al. | 123/179.31 |
| 5,432,384 | 7/1995 | Isozumi et al. | 290/48 |
| 5,454,543 | 10/1995 | Carrico | 248/674 |
| 5,796,172 | 8/1998 | Morisita et al. | 290/48 |

OTHER PUBLICATIONS

"Engine Starting Systems," Ingersoll–Rand® Catalog, 1997.

*Primary Examiner*—Allan D. Herrmann
*Attorney, Agent, or Firm*—Leon Nigohosian, Jr.

[57] ABSTRACT

An annular housing extension for an engine starter housing which facilitates and assists in the installation of the engine starter onto an engine. The annular extension extends from a mounting flange and has an inner diameter to form a cylinder which substantially surrounds and is concentric with a pinion gear of an engine starter. The annular extension may be provided as an integral part of a starter housing or as a separate piece. The annular extension is provided with a leading edge which is rounded to form a chamfer and preferably has a radius of curvature which approaches, and most preferably, equals the diameter of a cylindrical outer wall of the annular extension.

4 Claims, 5 Drawing Sheets

ENGINE STARTER HOUSING AND AN ANNULAR HOUSING EXTENSION THEREFOR

BACKGROUND OF THE INVENTION

This invention relates generally to engine starter mounting devices and more particularly to engine starter housings and annular housing extensions therefor which facilitate the installation of an engine starter onto an engine.

Pre-engaged engine starters are typically mounted to engines to be started by inserting a drive pinion of the engine starter into the engine block and securing a mounting flange of the engine starter housing to the engine. The pinion gear of the engine starter is then engaged with the ring gear of the engine which is subsequently driven to deliver power to start the engine. In the past, these engine starters have been installed by relying on a step portion protruding from the mounting flange portion of the engine starter housing to pilot the engine starter into alignment prior to securing the mounting flange to the engine. The installation of such prior art engine starters is difficult and cumbersome, however, and typically requires more than one person to align, hold, and mount the engine starter to the engine.

The foregoing illustrates limitations known to exist in present engine starter housing designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

The present invention provides an annular housing extension to the drive portion of an engine starter housing which facilitates and assists in the installation of the engine starter onto an engine. In one embodiment the annular extension extends from a mounting flange and has an inner diameter to form a cylinder which substantially surrounds and is concentric with a pinion gear of an engine starter. The annular extension may be provided as an integral part of a starter housing or as a separate piece which is attached thereto.

In a preferred embodiment, the annular extension is provided with a leading edge which is rounded to form a chamfer. In another embodiment, the annular extension is provided with a leading edge having a radius of curvature which approaches, and most preferably, equals the diameter of a cylindrical outer wall of the annular extension.

It is to be understood that both the foregoing general description and the following detailed description are exemplary, but are not restrictive, of the invention. The foregoing and other aspects will become apparent from the following detailed description of the invention when considered in conjunction with the accompanying drawing figures.

DETAILED DESCRIPTION OF THE INVENTION

Figure 1:
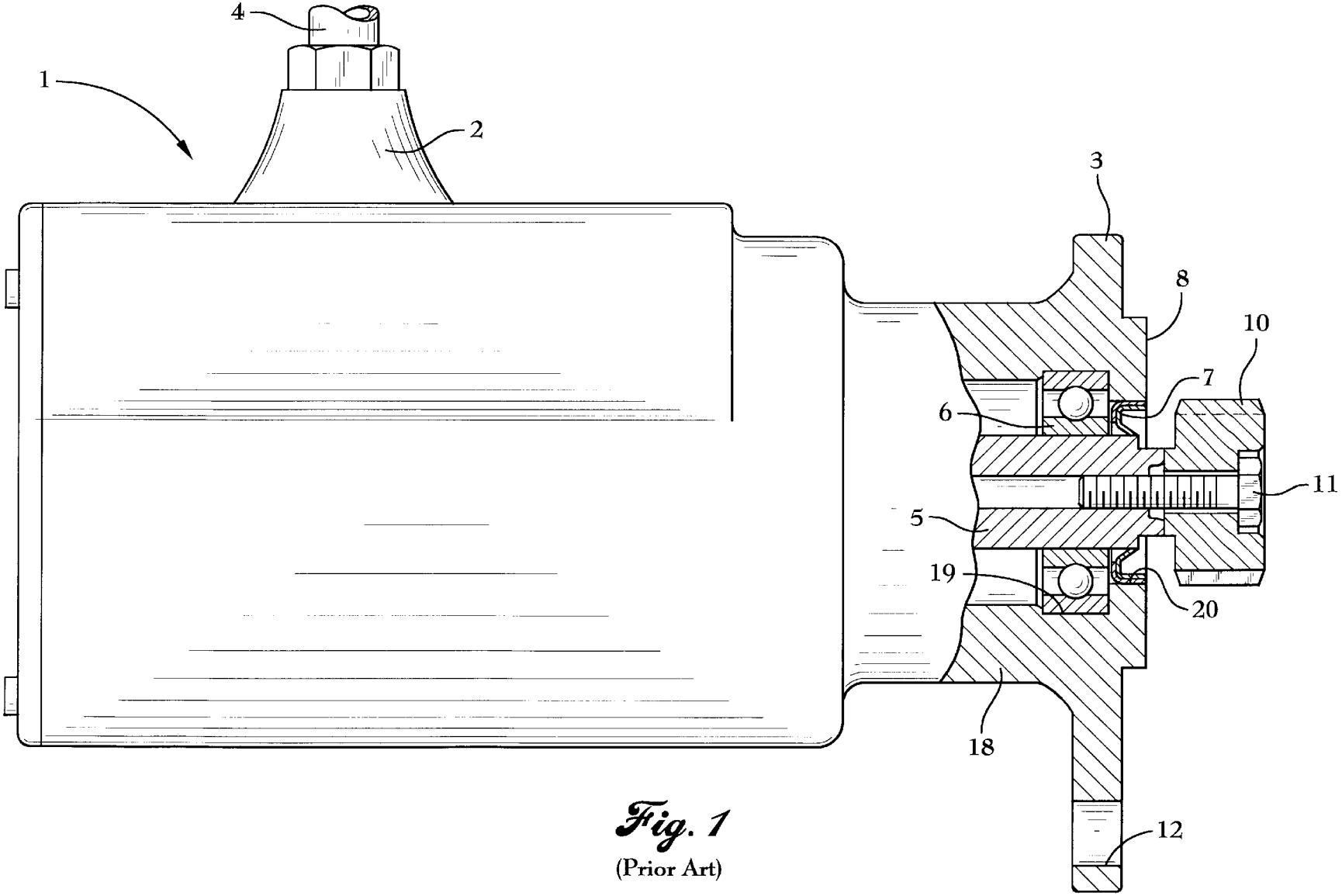
Fig. 1 (Prior Art)
FIG. 1 is a partial cross sectional view illustrating an engine starter having a conventional housing configuration.

The apparatus of the present invention are best understood from the following detailed description when read in connection with the drawing figures in which like reference numerals refer to like elements throughout. The following description is provided in order to fully understand the nature of the invention. Although it will be described in terms of an engine starter housing for an air starter, it should be understood that the housing configuration is equally applicable to electric starters or other similar devices which are to be mounted to an engine. It is emphasized that according to common practice, the various dimensions of the apparatus shown in the drawings are not to scale.

The operation of and advantages provided by the engine starter housing according to the present invention are best understood with an understanding of the operation of a conventional engine housing starter design shown in FIG. 1. Referring now to the drawing, wherein like reference numerals refer to like elements throughout, FIG. 1 shows a conventional engine starter 1 having a generally cylindrical starter housing 18 and a power connection port 2 provided to connect a motive fluid supply to the starter. Typically, the motive fluid is supplied in the form of a pressure fluid, such as compressed air, by a piping connection 4 as shown.

In a typical engine starter, the pressure fluid would be expanded in a motor which, when activated, has its output on a rotating pinion shaft 5, as shown partially sectioned in FIG. 1. The rotary output of pinion shaft 5 is transferred to a pinion gear 10 secured to the shaft by means of a threaded bolt 11. Pinion gear 10 is adapted to selectively contact and drive a gear (not shown) of an engine to be started. Typically the engine gear is a ring gear although other forms of engagement between pinion gear 10 and the engine may be employed as are known in the art. For purposes of the present invention, it may be assumed that pinion shaft 5 is translated axially into engagement to begin a starting cycle and is withdrawn once the engine has started.

A mounting flange 3 is provided to secure engine starter 1 to an engine by means of, for example, inserting a plurality of mounting bolts through a plurality of mounting bolt holes 12 which secure the mounting flange 3 to the engine. Mounting flange 3 is further provided with an internal bearing bore 19 which accepts a bearing 6. Bearing 6 centralizes pinion shaft 5 and permits its rotation within the starter housing 18. A seal bore 20 is further provided for accepting a seal 7 which prevents foreign matter from entering the interior of starter housing 18.

Located between pinion gear 10 and mounting flange 3 is a step portion 8 which protrudes approximately one-quarter inch from mounting flange 3 of starter housing 18. The diameter of step portion 8 is configured to fit into and pilot engine starter 1 into alignment with a mounting hole of an engine block (not shown) prior to securing mounting flange 3 to the engine. As discussed above, however, the installation of such a conventional starter housing configuration is difficult, cumbersome, and typically requires more than one person to align, hold, and mount the engine starter to the engine.

According to the present invention, an extension to the drive portion of an engine starter housing is provided which facilitates and assists in the installation of the engine starter onto an engine. Turning now to FIGS. 2–5, an engine starter

Figure 2:
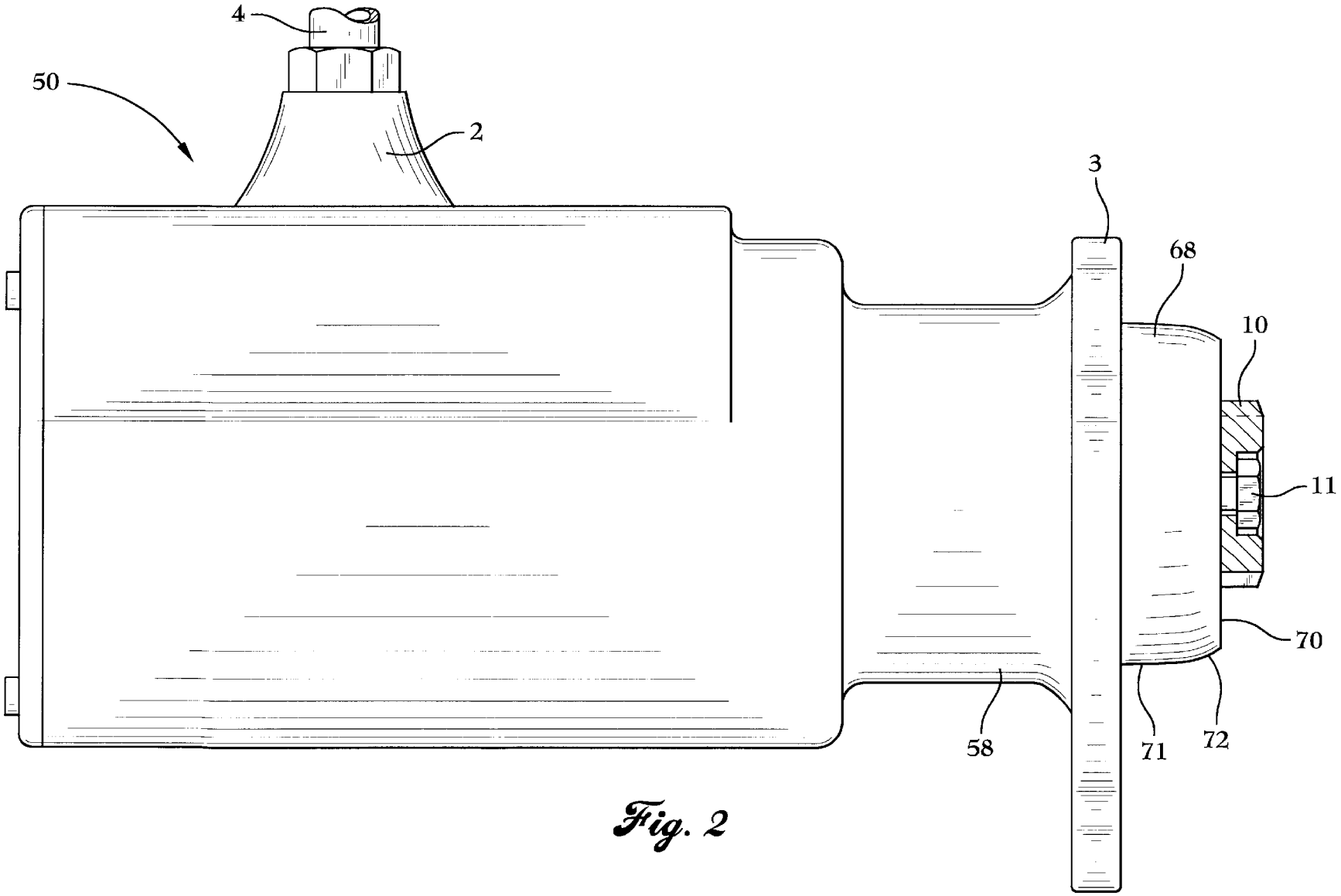
FIG. 2 is partial cross sectional view of an engine starter illustrating an embodiment of the engine starter housing having a housing extension according to the present invention.
Figure 3:
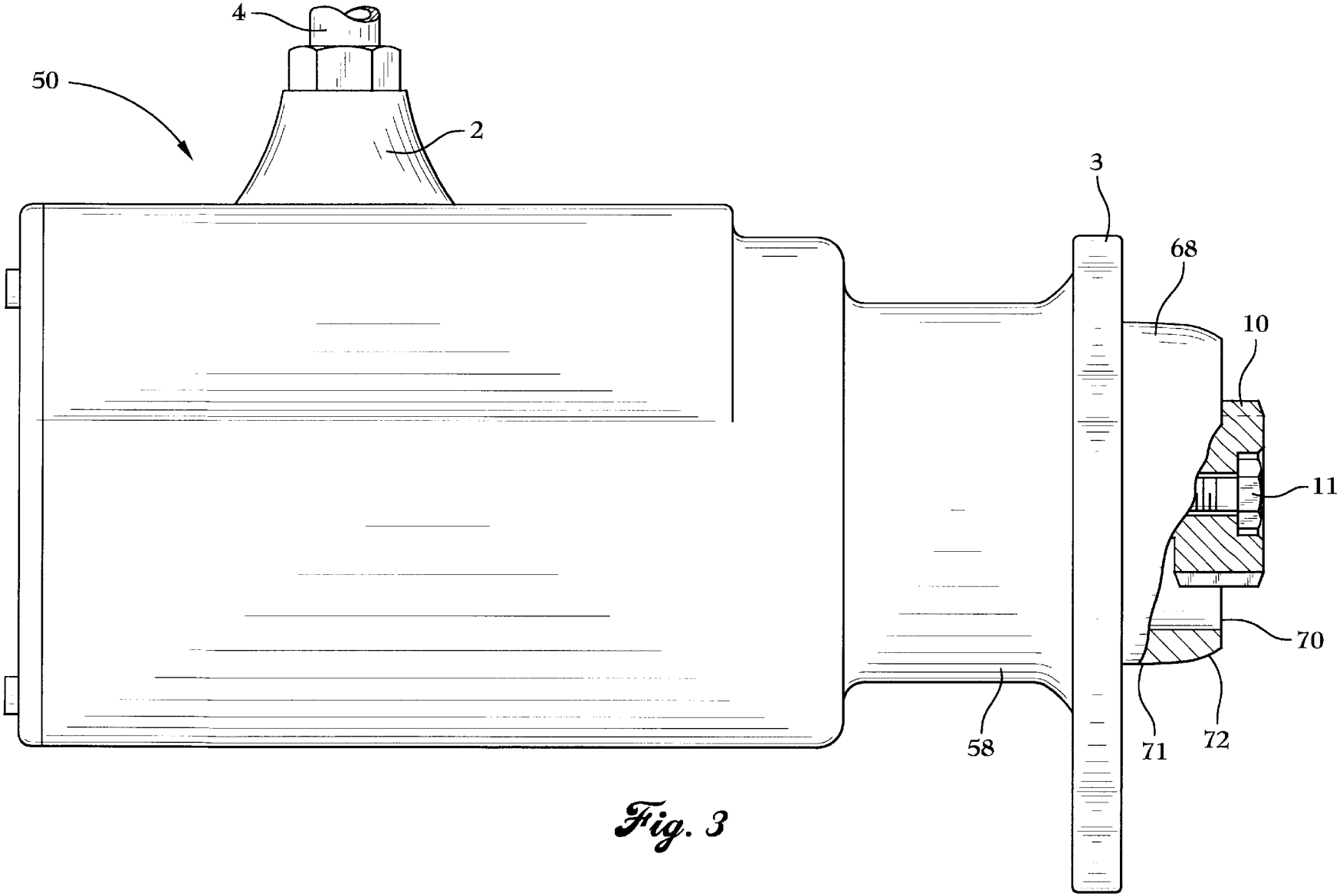
FIG. 3 is partial cross sectional view showing in greater sectional detail the housing extension of FIG. 2.
Figure 4:
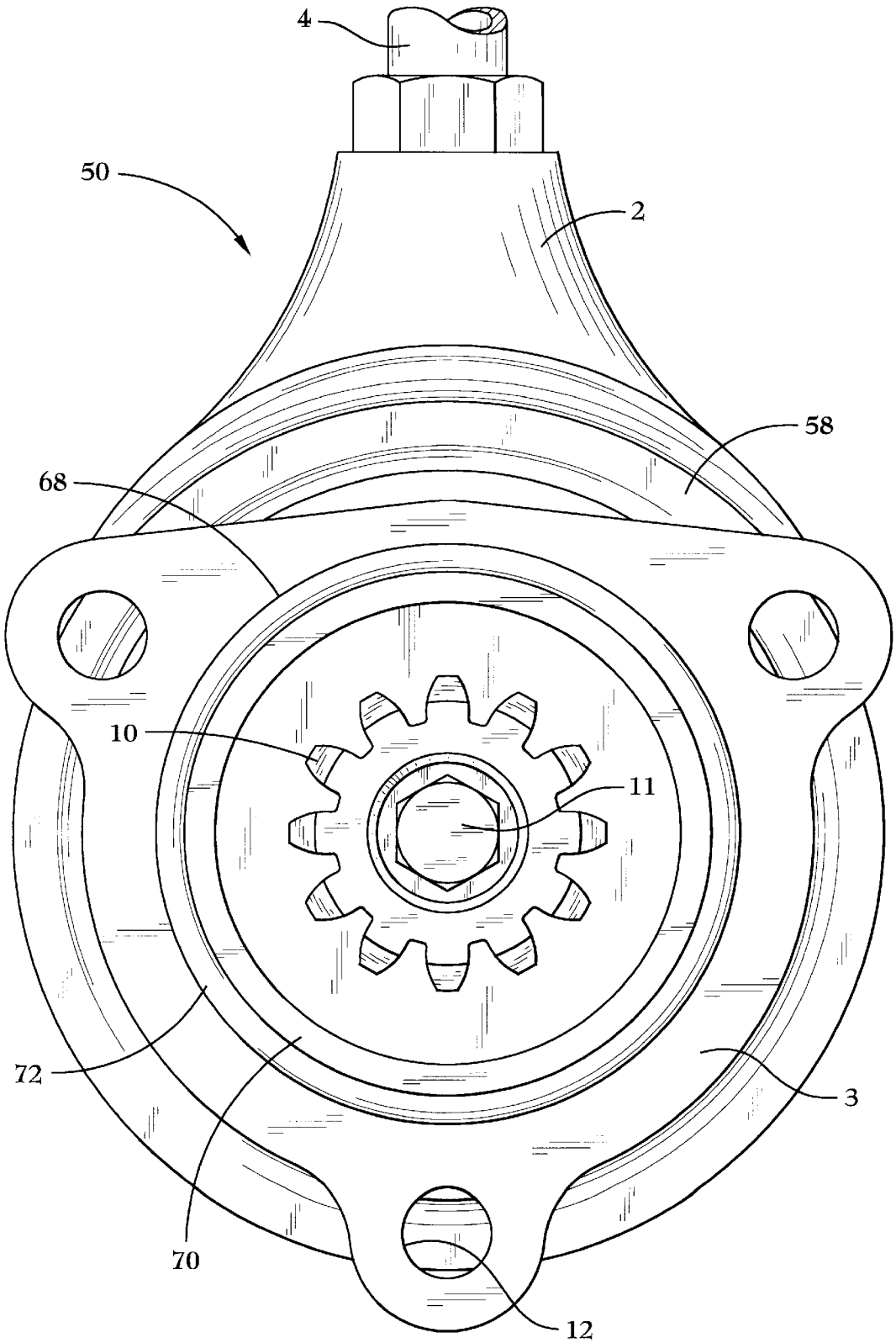
FIG. 4 is a planar frontal view showing the drive portion of the engine starter of FIGS. 2 and 3.

50 having a starter housing 58 according to the present invention is shown for which the component parts in common with those of the conventional engine starter 1 of FIG. 1 are referenced using like numbers. According to the present invention, shown in FIGS. 2–5 is an engine starter 50 having an annular extension 68 located on the drive portion of a starter housing 58. As shown in FIGS. 2–4, annular extension 68 extends from mounting flange 3 with an inner diameter to form a cylinder which substantially surrounds and is concentric with threaded bolt 11 and pinion gear 10. Annular extension 68 is open at one end to permit passage of pinion gear 10 therethrough. Annular extension 68 may be provided as an integral part of starter housing 58 or as a separate piece which is attached thereto.

Figure 5:
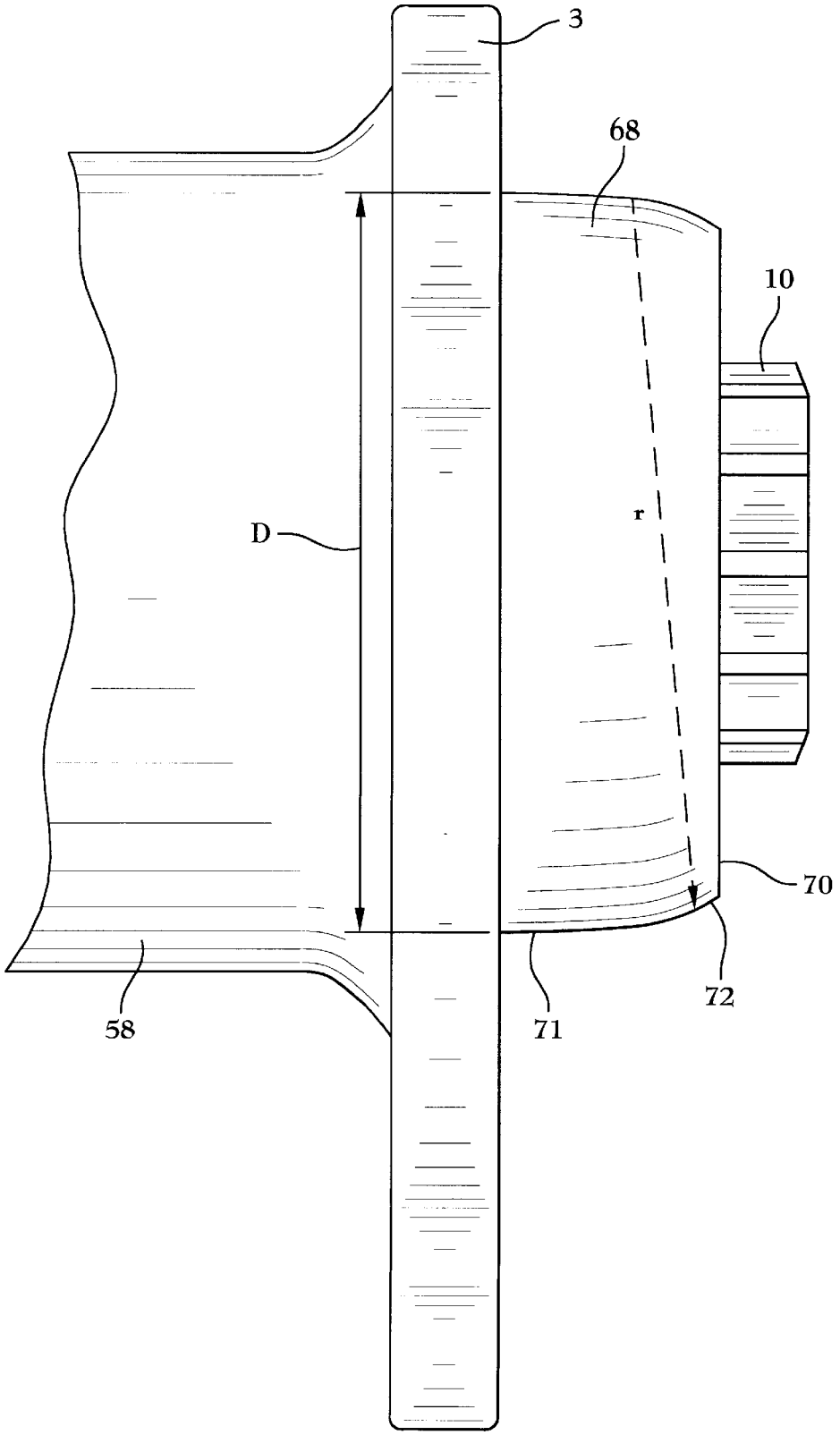
FIG. 5 is an exploded planar side view showing the drive portion of the engine starter of FIGS. 2–4.

Annular extension 68 has a cylindrical outer wall 71 which extends from its point of attachment with mounting flange 3 and is configured with an outer diameter selected to fit into a mounting hole of an engine block. Cylindrical outer wall 71 terminates with a front face 70 which is transverse to the longitudinal axis of annular extension 68. In a preferred embodiment, annular extension 68 is provided with a leading edge 72 which is rounded to form a chamfer with front face 70 as shown best by the sectional view of FIG. 3. Preferably leading edge 72 is provided with a radius of curvature "r" which approaches, and most preferably, equals the diameter "D" of cylindrical outer wall 71 as shown in FIG. 5.

Although annular extension 68 is shown extending only partially along the longitudinal axis of pinion gear 10 in FIGS. 2–5, it is to be understood that annular extension 68 may be extended cylindrically along the entire length of pinion gear 10 so that front face 70 is flush with the leading face of pinion gear 10 or may be otherwise located at any point therebetween.

It should be appreciated by one skilled in the art that by the various embodiments of the annular extension 68 described above, the present invention provides for a starter housing 58 which assists in the installation of an engine starter 50 onto an engine by facilitating the insertion and alignment of the drive portion of the engine starter with a mounting hole of an engine block prior to securing the mounting flange to the engine.

Although illustrated and described above with respect to certain specific embodiments, the present invention is nevertheless intended to be limited to the details shown. Rather various modifications may be made in the details within the scope and range of equivalents of the claims and without departing from the spirit of the invention.

What is claimed is:

1. A housing for an engine starter, said housing having a drive portion, comprising:

a mounting flange; and an annular extension extending from said mounting flange and being open at one end to form a cylinder, said cylinder having an inner diameter that substantially surrounds and concentrically receives a pinion gear of said engine starter, and a cylindrical outer wall having an outer diameter, said cylindrical outer wall comprising a front face which is transverse to a longitudinal axis of said annular extension, and a leading edge which is rounded to form a chamfer with said front face, said chamfer having a radius of curvature which approaches said outer diameter of said cylindrical outer wall.

2. A housing according to claim 1, wherein said radius of curvature equals said outer diameter of said cylindrical outer wall.

3. An annular housing extension for attachment to a drive portion of an engine starter, said extension comprising a cylinder having:

an inner diameter configured to substantially surround and concentrically receive a pinion gear of said engine starter, and a cylindrical outer wall having an outer diameter, said cylindrical outer wall further comprising a leading edge which is rounded to form a chamfer and has a radius of curvature which approaches said outer diameter or said cylindrical outer wall.

4. An annular housing extension according to claim 3, wherein said radius of curvature equals said outer diameter of said cylindrical outer wall.

* * * * *